United States Patent [19]

Hokanson

[11] 3,990,713

[45] Nov. 9, 1976

[54] PROTECTIVE PLATE FOR A SKATEBOARD

[76] Inventor: Jack W. Hokanson, 2001 Eastwood, Suite E, Santa Ana, Calif. 92707

[22] Filed: Sept. 2, 1975

[21] Appl. No.: 609,238

[52] U.S. Cl. ..... 280/87.04 A; 280/11.2

[51] Int. Cl.[2] ..... A63C 17/00

[58] Field of Search ..... 280/87.04 A, 11.2, 8, 280/7.13, 11.37 E, 11.1 R, 11.1 BR, 11.1 BT, 11.19; D34/15 AJ; 272/70, 57 D

[56] References Cited

UNITED STATES PATENTS

| | | | |
|---|---|---|---|
| 939,536 | 11/1909 | Nesbitt, Sr. | 280/162 |
| 1,802,116 | 4/1931 | Kinsley | 280/7.13 |
| 2,253,012 | 8/1941 | Benner et al. | 280/11.1 BT |
| 3,235,282 | 2/1966 | Bostick | 280/87.04 A |
| 3,565,454 | 2/1971 | Stevenson | 280/87.04 A |
| 3,622,172 | 11/1971 | Goodwin | 280/11.2 |
| D222,158 | 10/1971 | Noches | D34/15 AJ |

FOREIGN PATENTS OR APPLICATIONS

| | | | |
|---|---|---|---|
| 1,029,590 | 5/1966 | United Kingdom | 280/87.04 A |

*Primary Examiner*—Robert R. Song
*Assistant Examiner*—David M. Mitchell
*Attorney, Agent, or Firm*—Raymond L. Madsen

[57] ABSTRACT

There is disclosed a protective plate for a skateboard comprising a rigid base member having a mounting bracket thereon with a plurality of holes therethrough adapted to receive bolts from a skateboard wheel assembly for securing the mounting bracket between the wheel assembly and a skateboard body. The rigid base member has a cantilever frame which projects from the mounting bracket and is adapted to extend along and mechanically support and protect the end of the skateboard body adjacent the wheel assembly.

5 Claims, 8 Drawing Figures

PROTECTIVE PLATE FOR A SKATEBOARD

The present invention relates to skateboards and more particularly to kick plates, skid plates, brake plates and protective shoes for skateboards.

The present invention also relates generally to improvements in skateboards and the like and more particularly to new and improved skateboards wherein a protective shoe or plate is attached to the underside of one or more ends thereof to provide mechanical strength and a skidding and braking surface therefor.

In the field of skateboards, it has been the general practice to employ metal, wooden or fiberglass skateboard bodies to provide a strong and durable assembly. Although such materials have served the purpose, they have not proved entirely satisfactory under all conditions of service for the reason that considerable difficulty has been experienced in reducing the cost of materials utilized in the construction of skateboards.

Those concerned with the development of skateboards have long recognized the need for low-cost materials for use in the construction of skateboard bodies. One of the materials considered for low-cost skateboard bodies is injection molded plastic. Although plastic has been used to provide a low-cost skateboard body, it has not proved satisfactory under all conditions for the reason that considerably difficulty has been experienced in making a skateboard body having an arched or curved end thereon for the purpose of enabling the skateboard operator to perform special operating maneuvers. It has been found that injection molded plastic does not have the strength necessary to support the operator's weight and the forces exerted on the arched or curved end during the performance of the special maneuvers. The general practice has been to construct such skateboards having arched ends out of fiberglass or metal to provide the necessary strength. The maneuvers performed by the skateboard operator which impart extreme forces on the arched end of the skateboard involve tilting the skateboard about the wheel assembly adjacent the arched end whereby by the operator travels on the skateboard with only one wheel assembly in contact with the surface over which the skateboard is operated. This places at least one-half of the weight of the operator on the curved end producing a torque on the arched end sufficient to break or fracture injection molded plastic materials. To obtain the necessary strength from injection molded plastic, such thicknesses must be used which defeat the objective of obtaining a low-cost skateboard body and further creates problems in the molding process to achieve such thicknesses. The present invention overcomes the difficulties and problems by making it possible to utilize injection molded plastic for the construction of skateboard bodies and in particular to skateboard bodies having an arched or curved end thereon.

Those concerned with the development of lightweight, low-cost skateboard bodies have long recognized the need for a way of providing mechanical strength to the arched or curved ends of skateboard bodies. The present invention fulfills this need.

The general purpose of this invention is to provide a low-cost, lightweight skateboard which embraces all the advantages of similarly employed fiberglass, metal and wood constructed skateboards and possesses non of the aforedescribed disadvantages. To attain this, the present invention contemplates a unique protective plate or shoe attached to the ends of an injection molded skateboard whereby fracture and breaking of the ends is avoided and a low-cost skateboard body is achieved.

An object of the present invention is the provision of a protective supporting plate attached to the ends of a skateboard whereby lightweight, low-cost injection molded plastic may be used to fabricate the skateboard body.

Another object is to provide a protective shoe for a skateboard to strengthen the end of the skateboard and to provide a braking and skidding surface for the operator thereof.

Still another object is to provide strength to the arched ends of a skateboard and a protecting surface for the arched end to enable the end to slide and skid over the surface upon which the skateboard is operated without damage to the skateboard.

Yet another object of the present invention is the provision of an end surface on a skateboard which produces sparks when skidded over a paved surface upon which the skateboard is operated.

Other objects and many of the attendant advantages of this invention will be readily appreciated as the same becomes better understood by reference to the following detailed description, when considered in connection with the accompanying drawings in which like reference numerals designate like parts throughout the figures thereof and wherein.

Figure 4:
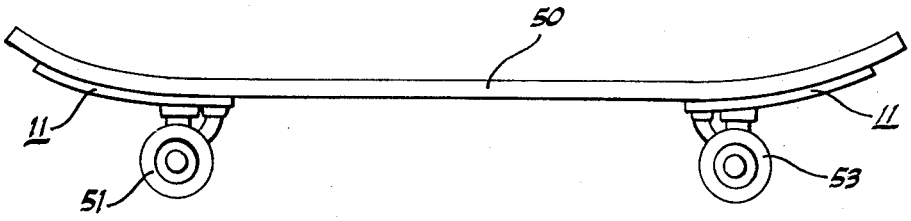
Figure 5:
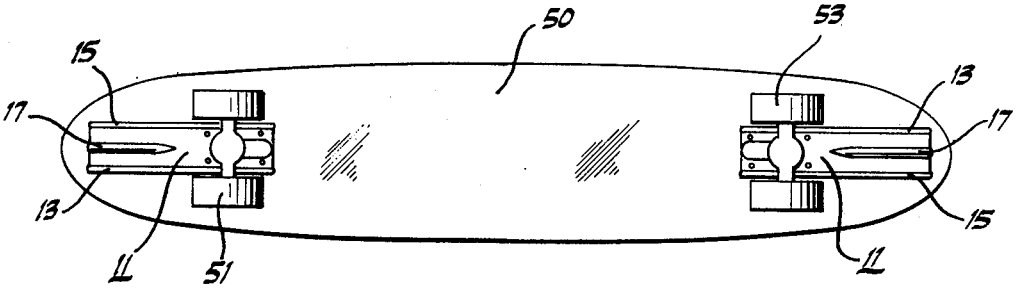

FIGS. 3*a*, 3*b*, 3*c* and 3*d* show a variety of alternate forms of the present invention viewed from the bottom thereof;

FIG. 4 illustrates a side elevation of a skateboard utilizing the present invention; and FIG. 5 is a bottom view of the skateboard illustrated in FIG. 4.

Figure 1:
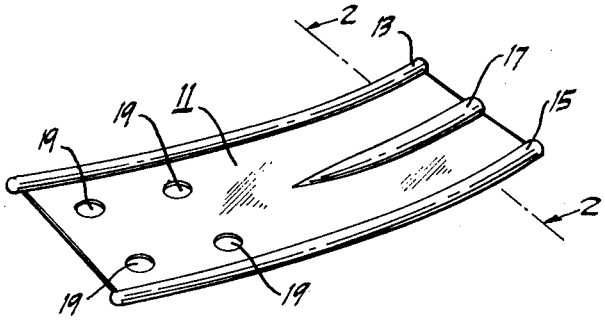
FIG. 1 shows a perspective view of a preferred embodiment of the invention.

Referring now to the drawings wherein like reference characters designate like or corresponding parts throughout the several views, there is shown in FIG. 1 (which illustrates a preferred embodiment) a rigid base member, protective plate or shoe 11 having a rectangular shape which is arched or curved and has a ridge, protrusion or rib 13 running lengthwise along one edge thereof, which rib extends outwardly from the surface. Another rib 15, similar to rib 13, extends along the opposite edge. Centrally located between ribs 13 and 15 parallel thereto is rib 17 which protrudes from the surface of rigid base member 11 and extends from the end thereof along the surface of rigid base member 11 to a mounting bracket area in which a plurality of holes 19 are located. Rigid base member or protective plate 11 may be made of a hard material, such as metal.

Figure 2:
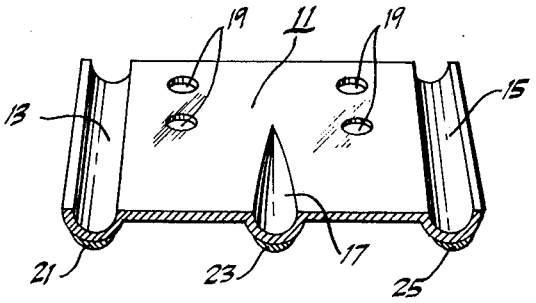
FIG. 2 illustrates a section of the device taken on line 2—2 of FIG. 1, looking in the direction of the arrows.

FIG. 2 shows a section of the protective plate illustrated in FIG. 1 in which the opposite sides of ribs 13, 15 and 17 are shown as stamped or depressed channels which may be formed by subjecting rigid base member 11 to a stamping press which creates channels in one side and protrusions in the other of rigid base member 11 to form ribs 13, 15 and 17. Rib 13 has a metal covering or coating 21 attached to the protruding or convex surface thereof, such as rhodium, the purpose thereof to be explained hereinafter. Similarly, rib 15 and rib 17 are coated or covered by metallic surfaces 15 and 23, respectively. The plurality of mounting holes 19 are shown in the mounting bracket area near the end of rigid base member 11 as it curves upward behind the section.

Figure 3A:
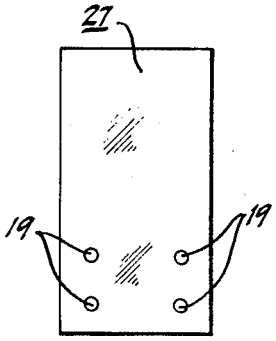

FIG. 3*a* illustrates an alternate embodiment of the present invention in the form of a rectangular rigid base member 27 viewed from the bottom, such that its arch or curve cannot be readily seen. The plurality of holes 19 in a bracket mounting area are illustrated adjacent one end of rigid base member 27.

Figure 3B:
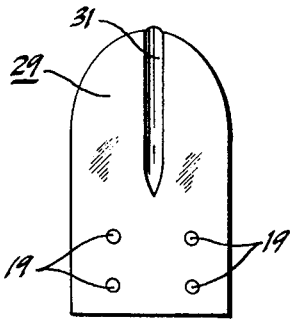

FIG. 3*b* illustrates another embodiment of the present invention in which a substantially rectangular rigid base member 29 has elongated rib 31 centrally located on the surface thereof and extending from one end and terminating in a mounting bracket region where a plurality of holes 19 are located.

Figure 3C:
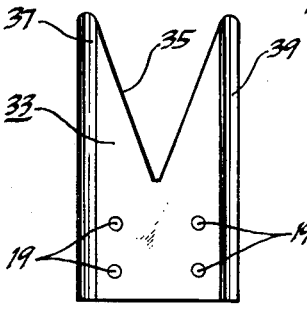

FIG. 3*c* shows a substantially rectangular rigid base member 33 having a V-slot centrally cut in one end thereof with ribs 37 and 39 extendinng the length of rigid base member 33 adjacent the respective edges thereof. The apex of the V 35 extends to a mounting bracket region wherein a plurality of holes 19 are located.

Figure 3D:
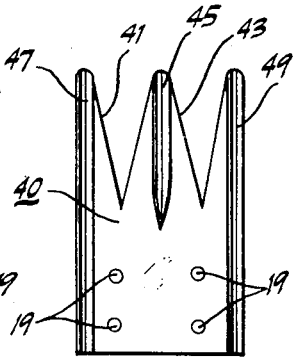

FIG. 3*d* shows a substantially rectangular protective plate or rigid base member 40 having a dual set of V's 41 and 43 cut in one end thereof so as to form three projecting fingers. Rib 45 extends from the tip of the middle finger to a mounting bracket region in which a plurality of holes 19 are located. Rib 47 extends the length of rigid base member 40 along one edge thereof and rib 49 extends the length of rigid base member 40 along the other edge thereof.

Turning now to FIG. 4, there is shown a side view of a skateboard 50 having rigid base member or protective plate 11 attached thereto. Skateboard 50 is illustrated with both ends being arched or curved upwardly with a rigid base member 11 attached to the underside of the convex surface of each curved end. A wheel assembly 51 is shown attached through the plurality of holes 19 (not illustrated) in rigid base member 11 at one end and wheel assembly 53 is shown attached through plurality of holes 19 (not illustrated) in a second rigid base member 11 at the other end of skateboard 50. Skateboard 50 is made of injection molded plastic or other lightweight, low-cost construction material of a similar nature.

In FIG. 5 the bottom of the skateboard illustrated in FIG. 4 is shown with a protective plate or rigid base member 11 attached to each end thereof. Wheel assemblies 51 and 53 are shown mounted respectively over the mounting bracket area of a rigid base member 11 with bolts passing through a plurality of holes 19 (not illustrated) in a mounting bracket region in rigid base member 11. Ribs 13 and 15 extend the length of rigid base member 11 along the edges thereof with rib 17 centrally located therebetween and extending from one end to the mounting bracket region of rigid base member 11.

Operation of the invention can best be described by referring to FIG. 4. Although rigid base member of protective plate 11 is shown attached to the underside of the arched or curved ends of skateboard 50, it should be understood that any of the ridid base members or protective plates described in FIGS. 3*a*, 3*b*, 3*c* and 3*d*, or any protective plate or similar form and construction may be used. It should also be noted that rigid base member 11 may be integrally molded in the body of skateboard 50 to provide further mechanical strength and simplicity in construction. The plurality of holes 19 located in the mounting bracket region or region base member 11 are aligned to mate with and match with the mounting holes in the wheel assemblies 51 or 53. When the wheel assemblies 51 and 53 are bolted through the plurality of holes 19 in the respective rigid base member 11 and into the body of skateboard 50, the arched or curved portion of each rigid base member 11 becomes a cantilever adjacent to and in contact with the arched or curved end of skateboard 50. Therefore, when weight or forces are applied to the arched or curved ends of skateboard 50, each rigid base member 11 supports the respective curved end to prevent the end from breaking or fracturing. As a result, lightweight construction materials can be used to fabricate skateboard 50 such as injection molded plastic to achieve a low-cost and lightweight skateboard.

Turning now to FIG. 5, it should be clear that ribs 13, 15 and 17, which protrude or extend from the surface of rigid member 11, form a sliding or braking surface for the skateboard when the skateboard is tilted about the wheel assembly associated therewith. For example, when the operator of the skateboard shifts his body weight to the curved or arched end of skateboard 50, the skateboard will tilt about the wheel assembly associated therewith until ribs 13, 14 and 17 come in contact with the surface over which the skateboard is being operated. This will cause ribs 13, 15 and 17 of rigid base member 11 to slide or skid over the surface causing a braking action opposed to the motion of the skateboard. Therefore, the skateboard may be slowed or stopped altogether by applying more or less force or weight on the end of the skateboard to create more or less frictional forces between ribs 13, 15 and 17 with the operating surface over which the skateboard is traversing.

Turning now to FIG. 2, if ribs 13, 15 and 17 are coated with a metallic material, such as rhodium, or if rigid base member 11 is constructed from a rhodium material, then as the ribs skid or slide over a paved surface upon which the skateboard is being operated, a shower of sparks will be emitted adding a very dramatic appearance to the maneuvering of the skateboard.

Because rigid base member or protective plate 11 may be utilized in a skidding or braking manner with skateboard 50, it may be referred to as a skid plate or brake plate. Further, by pressing rapidly downward on the arched or curved end of the skateboard, the operator may "kick" the skateboard into the air and catch it without bending over. Since rigid base member 11 will sharply strike the operating surface over which the skateboard is placed in response to the swift kick given by the operator, rigid base member 11 may be referred to also as a kick plate. Consequently, a skateboard constructed with the present invention enables the operator thereof to engage in braking, sliding, and kicking maneuvers heretofore not possible without incurring damage to the skateboard body or ends thereof.

It now should be apparent that the present invention provides a protective plate or rigid base member which may be employed in conjunction with a skateboard for increasing the strength of the ends of the skateboard and providing a sliding, braking and kicking surface which may be utilized by the operator of the skateboard in conjunction with various maneuvers.

Although particular components, etc., have been discussed in connection with a specific embodiment of a protective plate or rigid base member constructed in accordance with the teachings of the present invention, others may be utilized. Furthermore, it will be understood that although an exemplary embodiment of the present invention has been disclosed and discussed, other applications and mechanical arrangements are possible and that the embodiments disclosed may be subjected to various changes, modifications and substitutions without necessarily departing from the spirit of the invention.

What is claimed is:

1. A protective plate for a skateboard comprising, a rigid base member having a mounting bracket thereon with a plurality of holes therethrough adapted to receive bolts from a skateboard wheel assembly for securing said mounting bracket between the wheel assembly and a skateboard body, said rigid base member having a cantilever frame which projects from said mounting bracket and is adapted to extend along and mechanically support and protect the end of the skateboard body adjacent the wheel assembly, said cantilever frame having at least one rib projecting from the surface thereof for adding mechanical strength to said cantilever frame and for providing a spliting contact with a surface over which the skateboard is moved when the skateboard is tilted to cause the end thereof to contact the surface.

2. The protective plate for a skateboard described in claim 1 wherein said at least one rib has a surface made of a metal of the type such as rhodium for providing sparks when said at least one rib moves in sliding contact with a paved surface over which the skateboard is operated.

3. A protective plate for a skateboard comprising;

a rigid base member having a mounting bracket thereon with a plurality of holes therethrough adapted to receive bolts from a skateboard wheel assembly for securing said mounting bracket between the wheel assembly and a skateboard body, said rigid base member having a cantilever frame which projects from said mounting bracket and is adapted to extend along and mechanically support and protect the end of the skateboard body adjacent the wheel assembly, said rigid base member being a substantially rectangular plate, one end thereof being the mounting bracket and the remaining portion thereof being the cantilever frame, said rectangular plate having an elongated rib centrally located on said remaining portion of said substantially rectangular plate forming said cantilever frame.

4. The protective plate for a skateboard described in claim 3 further including two additional elongated ribs, each additional rib extending the length of said substantially rectangular plate adjacent one edge thereof.

5. A protective plate for the arched end of a skateboard, comprising a metal plate adapted to be secured to the underside of an arched end of a skateboard, said metal plate being arched to mate with and match the curved surface of the skateboard arched end, one end of said metal plate being adapted to be mechanically secured between the body and a wheel assembly of the skateboard adjacent the arched end thereof, said metal plate having a plurality of parallel elongated ribs for mechanical strength and for providing a ribbed skidding and braking surface at the arched end of the skateboard.

* * * * *